US005937668A

United States Patent [19]

Jun

[11] Patent Number: 5,937,668

[45] Date of Patent: Aug. 17, 1999

[54] HEAT EXCHANGER FIN FOR AN AIR CONDITIONER

[75] Inventor: Byoung-Chan Jun, Seoul, Rep. of Korea

[73] Assignee: Samsung Electronics Co., Ltd., Suwon, Rep. of Korea

[21] Appl. No.: 08/955,244

[22] Filed: Oct. 21, 1997

[30] Foreign Application Priority Data

Dec. 30, 1996 [KR] Rep. of Korea ..... 96-77584

[51] Int. Cl.[6] ..... F25D 21/14

[52] U.S. Cl. ..... 62/290; 165/151

[58] Field of Search ..... 62/285, 288, 290, 62/272, 404; 165/151

[56] References Cited

U.S. PATENT DOCUMENTS

| | | | |
|---|---|---|---|
| 2,042,420 | 5/1936 | Askin | 62/290 |
| 2,251,649 | 8/1941 | Wichmann | 62/290 |
| 2,433,825 | 1/1948 | Brothers | 62/288 |
| 3,902,551 | 9/1975 | Lim et al. | 165/111 |
| 4,350,025 | 9/1982 | Izumi | 62/285 |
| 5,111,876 | 5/1992 | Nash | 165/151 |

*Primary Examiner*—William Doerrler
*Attorney, Agent, or Firm*—Burns, Doane, Swecker & Mathis, L. L. P.

[57] ABSTRACT

A heat exchanger for an air conditioner includes a plurality of generally parallel fins, and refrigerant tubes passing through the fins. A portion of each fin is situated adjacent an air circulation fan. Those portions of the fins have a wavy configuration forming vertically extending valleys through which condensed water can flow in sheltered fashion without being sucked off the fins by the circulating air.

1 Claim, 2 Drawing Sheets

HEAT EXCHANGER FIN FOR AN AIR CONDITIONER

BACKGROUND OF THE INVENTION (1) Field of the Invention

The present invention relates to a heat exchanger (evaporator) used in an indoor air conditioner unit, and more particularly to a heat exchanger along which condensed water (due to dew-forming phenomenon) can flow without being sucked off by a fan.

(2) Description of the Prior Art

An indoor unit for a conventional air conditioner, as shown in FIG. 1, has a main body 10 housing, a heat exchanger 20 for heat-exchanging room air, and a cross fan 30. This fan 30, which is rotated in one direction, is placed at a rear, lower side of the heat exchanger 20, serving circulate room air to the heat exchanger 20. Further, the indoor unit includes a condensed water container 40 for collecting condensed water (i.e., dew) which is created due to the temperature difference between the refrigerant temperature in the heat exchanger 20 and the room temperature and flows downward along the surface of the heat exchanger and into the container which is placed beneath the heat exchanger 20.

The heat exchanger 20 has a plurality of flat fins 21 arranged in a parallel relation to each other at predetermined intervals and a plurality of heat exchanging tubes 22 passing through the fins 21 perpendicular thereto.

Each fin 21 has a plurality of slits 23 protruding from both sides of the flat fin 21, through which the flowing air currents become turbulent. The air is then heat exchanged with the fluid flowing in the heat exchanging tubes 22. The slits function to reduce a dead air region formed behind each tube in a direction of the air flow and to increase in the heat transferring area, whereby the heat transfer efficiency of the above heat exchanger is improved.

However, as shown in FIG. 2, the heat exchanger has a lower flat section H1 located adjacent to the cross fan 30. When the downwardly flowing condensed water reaches the lower side H1, some of the water, denoted as P in FIG. 2, is sucked into the cross fan 30 due to a rotational force thereof, and then may be dropped on the bottom surface of the main body 10. Such a leaked water may be undesirably discharged into a room.

SUMMARY OF THE INVENTION

Therefore, it is an object of the present invention to provide a heat exchanger having fins, each fin having wavelike surfaces in portions adjacent to a fan, by which condensed water created on surfaces of the fins and heat exchanging tubes flows along valley portions of the wavelike surfaces of the fins, and is thereby shielded from the fan-induced air flow. Thus, the water can be fully collected in an appropriate water container without being affected by the rotating fan.

According to the objects of the present invention, there is provided a heat exchanger for an air conditioner having a plurality of parallel heat exchanging tubes passing through fins perpendicular thereto, the fins being arranged in parallel to each other at predetermined intervals, and each heat exchanging tube having fluids flowing therethrough, characterized in that the portion of each fin disposed adjacent to the fan has a wavy surface, such that condensed water can flow along valleys formed by the waves and become fully collected in a water container without being affected by the air flow induced by the fan.

BRIEF DESCRIPTION OF THE DRAWINGS

The objects and advantages of the invention will become apparent from the following detailed description of a preferred embodiment thereof in connection with the accompanying drawing in which like numerals designate like elements, and in which.

DETAILED DESCRIPTION OF THE PREFERRED EMBODIMENT

The preferred embodiment according to the present invention will now be described in detail in accordance with the accompanying drawings. The same or corresponding elements or parts are designated with like references throughout the drawings.

Figure 1:
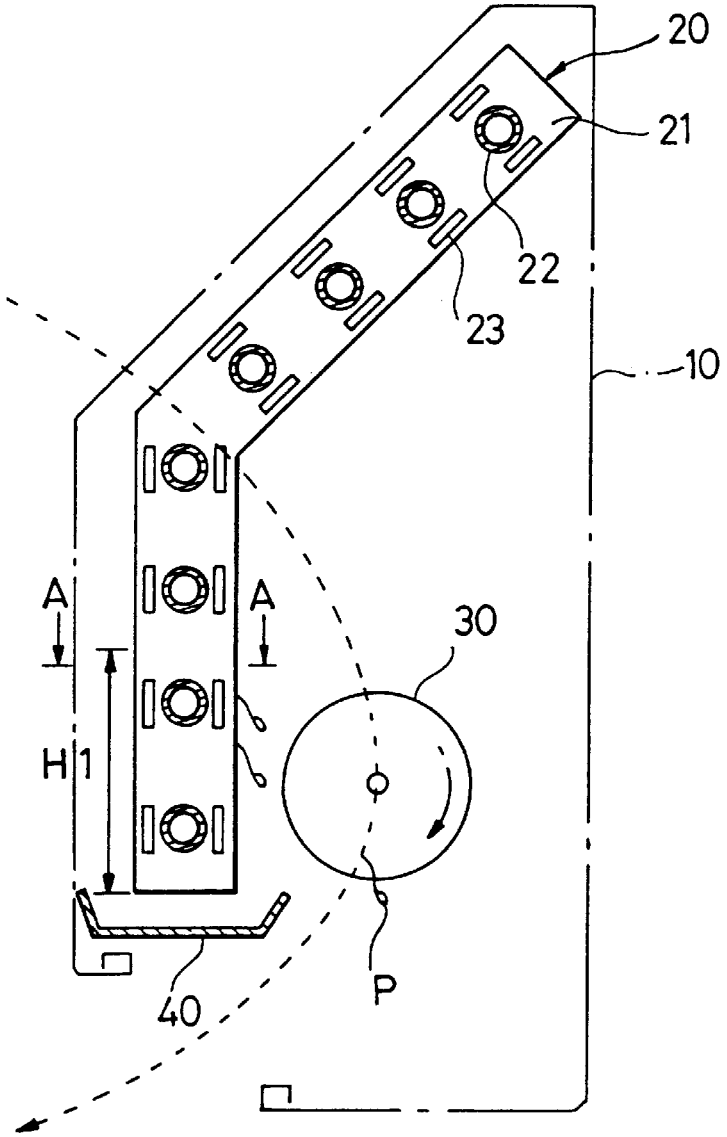
FIG. 1 (PRIOR ART)
FIG. 1 is a schematic side view of a conventional indoor unit.
Figure 2:
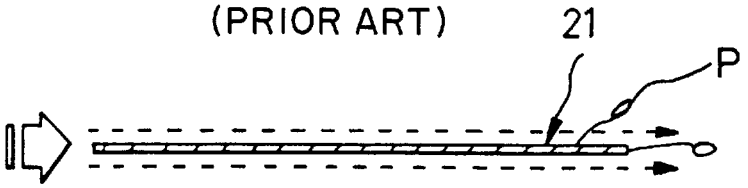
FIG. 2 (PRIOR ART)
FIG. 2 is a horizontal, sectional view taken along line A—A in FIG. 1.
Figure 3:
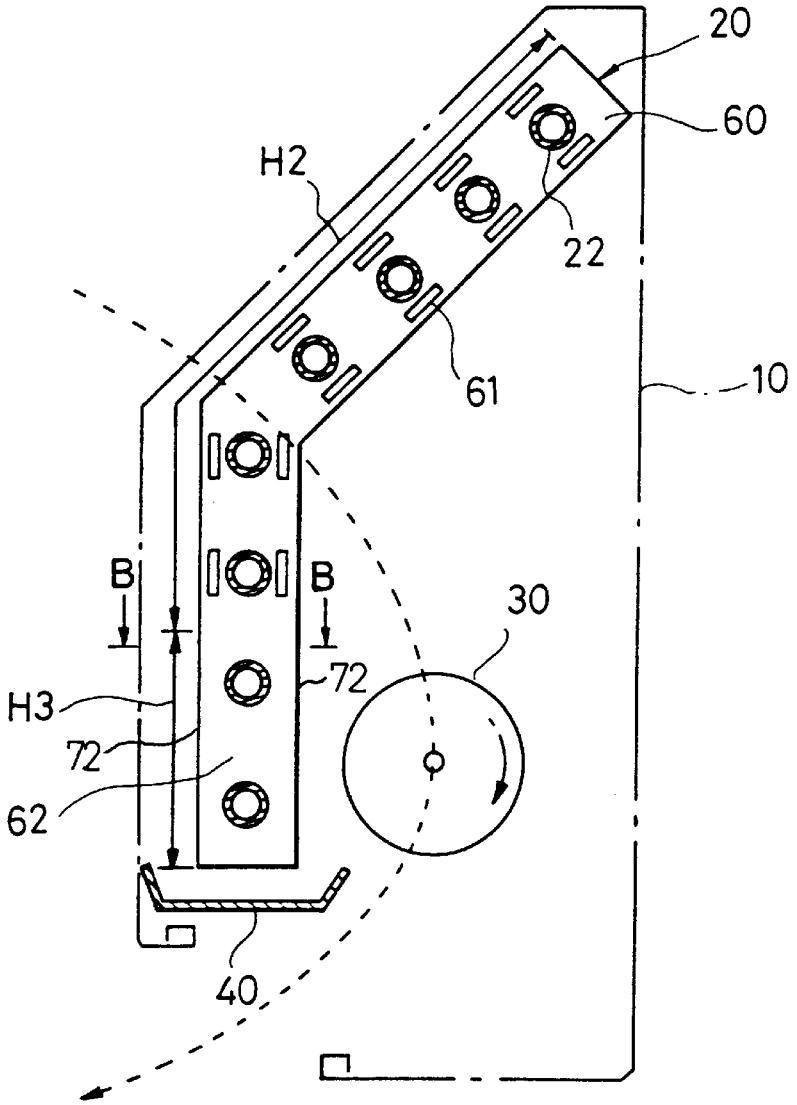
FIG. 3 is a schematic side view of an indoor unit in accordance with the present invention.

According to the present invention, each fin 60, as shown in FIG. 3, has an upper portion H2 located remote from the cross fan 30. Formed in that upper portion are a plurality of slits 61 protruding from both sides of the flat fin 60, through which the air currents flow to become turbulent before being heat exchanged with the fluid flowing in the heat exchanging tubes 22. The slits reduce a dead air region formed behind each tube in a direction of the air flow and increase the heat transferring area, thereby improving the heat transfer efficiency of the above heat exchanger. Further, the fin is provided with a lower portion H3, which is disposed adjacent to and in front of the cross fan 30. That lower portion H3 has wavelike surfaces 62 to ensure that condensed water is fully collected without being affected by the rotating fan 60, as will be explained.

Figure 4:
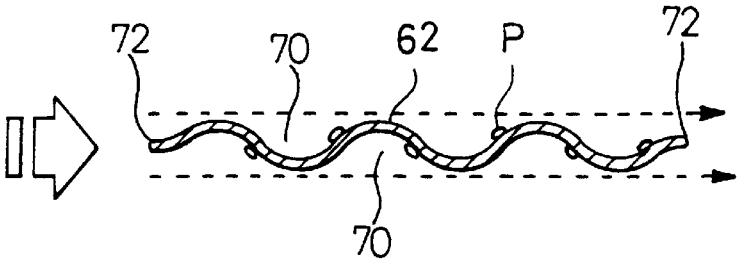
FIG. 4 is a horizontal, sectional view taken along line B—B in FIG. 3.

Over the wavelike surface 62 of the lower side H3, the air currents flow in a direction of the arrows in FIG. 4.

The operation and effect of the present invention will be described below.

If the room air is sucked in a direction of the dotted-line arrow in FIG. 3 by the rotating fan 30, the air passes through a space between fins 60 and is made turbulent by the slits 61 formed in each fin, and further by the wavelike surfaces 62. Then, a cold air is obtained by the heat exchanging of the air with the refrigerant circulating in the tubes 30.

During the heat-exchanging procedure, water condenses on the surfaces of the flat fin 61 and heat exchanging tubes 22, and flows downward along those surfaces, and is finally collected in the container 40 having a drainage provided to drain the collected water outside.

The condensed water flows within valleys 70 formed by the wavy surfaces. The valleys extend parallel to front and rear edges 72 of the fin and perpendicular to the air flow, whereby the condensed water P can flow in sheltered fashion along the valleys without being sucked towards the fan 30.

While the present invention has been described with reference to the illustrative example, the description is not intended to be construed in a limiting sense. For example, within the scope of the invention, the wavelike surface may be formed only on one side each flat fin.

What is claimed is:

1. An air conditioner comprising:

a body;

a fan mounted in the body for circulating air along a path through the body; and a heat exchanger mounted in the body and extending across the air path for changing a temperature of the air, the heat exchanger including a plurality of generally parallel fins and tubes extending through the fins for conducting refrigerant, each fin including a vertical front edge and a vertical rear edge with reference to a direction of air flow, an upper region of each fin being flat and inclined relative to vertical to overlie the fan, a lower region of each fin being disposed adjacent the fan and having a wavy configuration which is of uniformly sinusoidal shape from the front edge to the rear edge, the wavy configuration forming vertical valleys extending transversely relative to a direction of air flow past the portion of the fin for conducting condensed water vertically downwardly in sheltered relationship to the air flow, each fin including slits disposed upstream and downstream of at least one of the tubes for making the air turbulent.

* * * * *